US011098880B2

(12) United States Patent
Shaner et al.

(10) Patent No.: US 11,098,880 B2
(45) Date of Patent: Aug. 24, 2021

(54) LUMINAIRE WITH IMPROVED ASSEMBLY, INSTALLATION, AND WIRELESS FUNCTIONALITY

(71) Applicant: ABL IP Holding LLC, Atlanta, GA (US)

(72) Inventors: Jeff Robert Shaner, Loganville, GA (US); Travis Middleton, Decatur, GA (US); Jonathan Lemoine DeBow, Chamblee, GA (US)

(73) Assignee: ABL IP Holding LLC, Atlanta, GA (US)

( * ) Notice: Subject to any disclaimer, the term of this patent is extended or adjusted under 35 U.S.C. 154(b) by 157 days.

(21) Appl. No.: 16/216,110

(22) Filed: Dec. 11, 2018

(65) Prior Publication Data

US 2020/0182437 A1 Jun. 11, 2020

(51) Int. Cl.
*F21V 19/00* (2006.01)
*F21V 17/10* (2006.01)
(Continued)

(52) U.S. Cl.
CPC ..... *F21V 17/108* (2013.01); *F21K 9/61* (2016.08); *F21S 8/02* (2013.01); *F21V 15/01* (2013.01);
(Continued)

(58) Field of Classification Search
CPC ..... F21V 17/108; F21V 15/01; F21V 19/004; F21V 23/003; F21V 23/045; F21K 9/61;
(Continued)

(56) References Cited

U.S. PATENT DOCUMENTS 9,684,115 B1 * 6/2017 Carney ..... G02B 6/0091
2013/0301267 A1 * 11/2013 Badley ..... F21V 17/10 362/249.1
(Continued)

FOREIGN PATENT DOCUMENTS

| | | |
|---|---|---|
| DE | 102017112187 | 12/2017 |
| JP | 2006080007 | 3/2006 |
| JP | 2018098213 | 6/2018 |

OTHER PUBLICATIONS

EP19150818.3, "Extended European Search Report," dated Aug. 30, 2019, 10 pages.
(Continued)

*Primary Examiner* — Y M. Quach Lee
(74) *Attorney, Agent, or Firm* — Kilpatrick Townsend & Stockton LLP

(57) ABSTRACT

A luminaire assembly includes a frame and a back plate. In some examples, the frame includes a lip, and the back plate includes a tab. The back plate is positionable within a housing area of the frame such that the tab is engaged with the lip and the back plate is retained within the frame. In other examples, a luminaire assembly includes a wireless module with an antenna positioned adjacent to a module opening of the back plate. The antenna provides wireless transmissions above the top side of the back plate and below the bottom side of the back plate. A luminaire support clip for a luminaire assembly includes a base and a tab. The tab and the base define a receiving area, and the luminaire support clip receives a portion of an edge of a back plate of the luminaire assembly within the receiving area.

17 Claims, 10 Drawing Sheets

(51) Int. Cl.

| | |
|---|---|
| ***F21K 9/61*** | (2016.01) |
| ***F21S 8/02*** | (2006.01) |
| ***F21V 15/01*** | (2006.01) |
| ***F21V 23/00*** | (2015.01) |
| ***H01Q 1/22*** | (2006.01) |
| *F21Y 115/10* | (2016.01) |

(52) U.S. Cl.
CPC ..... *F21V 19/004* (2013.01); *F21V 23/003* (2013.01); *H01Q 1/22* (2013.01); *F21Y 2115/10* (2016.08)

(58) Field of Classification Search
CPC ..... F21S 8/02; F21S 8/03; H01Q 1/22; F21Y 2115/10
See application file for complete search history.

(56) References Cited

U.S. PATENT DOCUMENTS

| | | | | |
|---|---|---|---|---|
| 2016/0262245 | A1* | 9/2016 | Ando | F21S 8/026 |
| 2017/0339772 | A1* | 11/2017 | Ozaki | H05B 45/00 |
| 2017/0374724 | A1* | 12/2017 | Liszt | H05B 47/19 |
| 2018/0092192 | A1* | 3/2018 | Arai | F21V 3/049 |
| 2018/0238528 | A1* | 8/2018 | Hiramatsu | F21V 23/003 |

OTHER PUBLICATIONS

EP19150818.3, "Partial European Search Report," dated May 28, 2019, 11 pages.

* cited by examiner

LUMINAIRE WITH IMPROVED ASSEMBLY, INSTALLATION, AND WIRELESS FUNCTIONALITY

FIELD OF THE INVENTION

This application relates to luminaire assemblies, and, more particularly, to luminaire assemblies with components that are connected without fasteners. This application also relates to luminaire assemblies having wireless modules for wireless communication.

BACKGROUND

Many luminaire assemblies include a number of components that are secured together using fasteners such as screws, bolts, etc. or through joining techniques such as welding, riveting, etc. For example, some luminaire assemblies, particularly layered luminaire assemblies, include a top panel or back plate that is screwed down in multiple locations to a housing. As another example, some luminaire assemblies include luminaire support clips that are welded, screwed, or riveted to the housing. Such mechanisms and techniques require extra processing, have a higher material cost, and may cause the components to be secured together with an uneven pressure distribution. An uneven pressure distribution may create visible variations in light emitted through the lens. An uneven pressure distribution may also allow components to shift within the housing and potentially cause damage to the parts. For example, an uneven pressure distribution in a luminaire assembly may result in misalignment between a light source and a light guide, thereby creating dark and light bands in the luminaire that detrimentally impact illumination from the luminaire. Therefore, there is a need for luminaires that are easy to install and minimize variations in pressure distribution within the luminaire to provide more uniform illumination.

In addition, many luminaire assemblies are not "smart" enabled, meaning that they are not connected to other devices or networks via different wireless protocols (e.g., Bluetooth®, Wi-Fi®, near field communication, LiFi, 3G, etc.) and as such cannot operate interactively and/or autonomously. Moreover, traditional light fixtures are often difficult to retrofit with Bluetooth or other wireless capabilities because many components of the luminaire assemblies block the transmission of wireless signals and changes require modifying the light fixture in the field, which in most cases requires an inspector to be on site and approve the modifications. Therefore, there is still a need for a system that can accommodate wireless communications.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to some embodiments, a luminaire assembly includes a frame and a back plate. The frame includes a base and a sidewall. The frame defines a housing area for the luminaire assembly, and the sidewall includes a lip that extends from the sidewall over at least a portion of the base. The back plate is positionable within the housing area of the frame and includes a body and a tab extending from the body. The tab is selectively engageable with the lip such that the back plate is retained within the frame.

According to various embodiments, a method of assembling a luminaire includes positioning a back plate within a housing area defined by a frame that includes a base and a sidewall. The sidewall includes a lip that extends from the sidewall over at least a portion of the base, and the back plate includes a body and a tab extending from the body. The method includes retaining the back plate within the frame by engaging the tab of the back plate with the lip of the frame.

According to certain embodiments, a luminaire support clip for a luminaire assembly includes a base, a hook extending from the base, and a tab extending from the base. The tab is folded under the base such that the tab and the base define a receiving area, and the luminaire support clip is configured to receive a portion of an edge of a back plate of the luminaire assembly within the receiving area.

According to some examples, a luminaire assembly includes a back plate having a body with a perimeter edge. The luminaire assembly also includes a luminaire support clip having a base, a hook, and a tab. The tab and base define a receiving area, and a portion of the perimeter edge of the back plate is retained within the receiving area such that the luminaire support clip is removably engaged with the back plate.

According to certain examples, a method of assembling a luminaire includes assembling a luminaire support clip such that a hook of the luminaire support clip extends from a base of the luminaire support clip. The method includes positioning the luminaire support clip on a back plate by inserting a portion of a perimeter edge of the back plate within a receiving area defined by the base of the luminaire support clip and a tab of the luminaire support clip.

According to various examples, a luminaire assembly includes a back plate and a wireless module. The back plate includes a top side and a bottom side and defines a module opening extending from the top side to the bottom side. The wireless module includes an antenna positioned adjacent to the module opening. The antenna is configured to provide wireless transmissions above the top side of the back plate and below the bottom side of the back plate.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "left," "right," "front," and "back," among others are intended to refer to the orientation as illustrated and described in the figure (or figures) to which the components and directions are referencing.

Embodiments of the present invention are directed to a fastener-less enclosure for a luminaire. Embodiments of the present invention are also directed to a fastener-less luminaire support clip for a luminaire. Embodiments of the present invention are further directed to a luminaire with a wireless module that provides wireless transmissions above and below the luminaire. The luminaires described herein are provided with light emitting diodes (LEDs), but it will be recognized that the invention may be embodied in luminaires using other kinds of light sources such as fluorescent, incandescent, and/or other kinds of light sources.

Luminaire Assembly

Figure 1A:
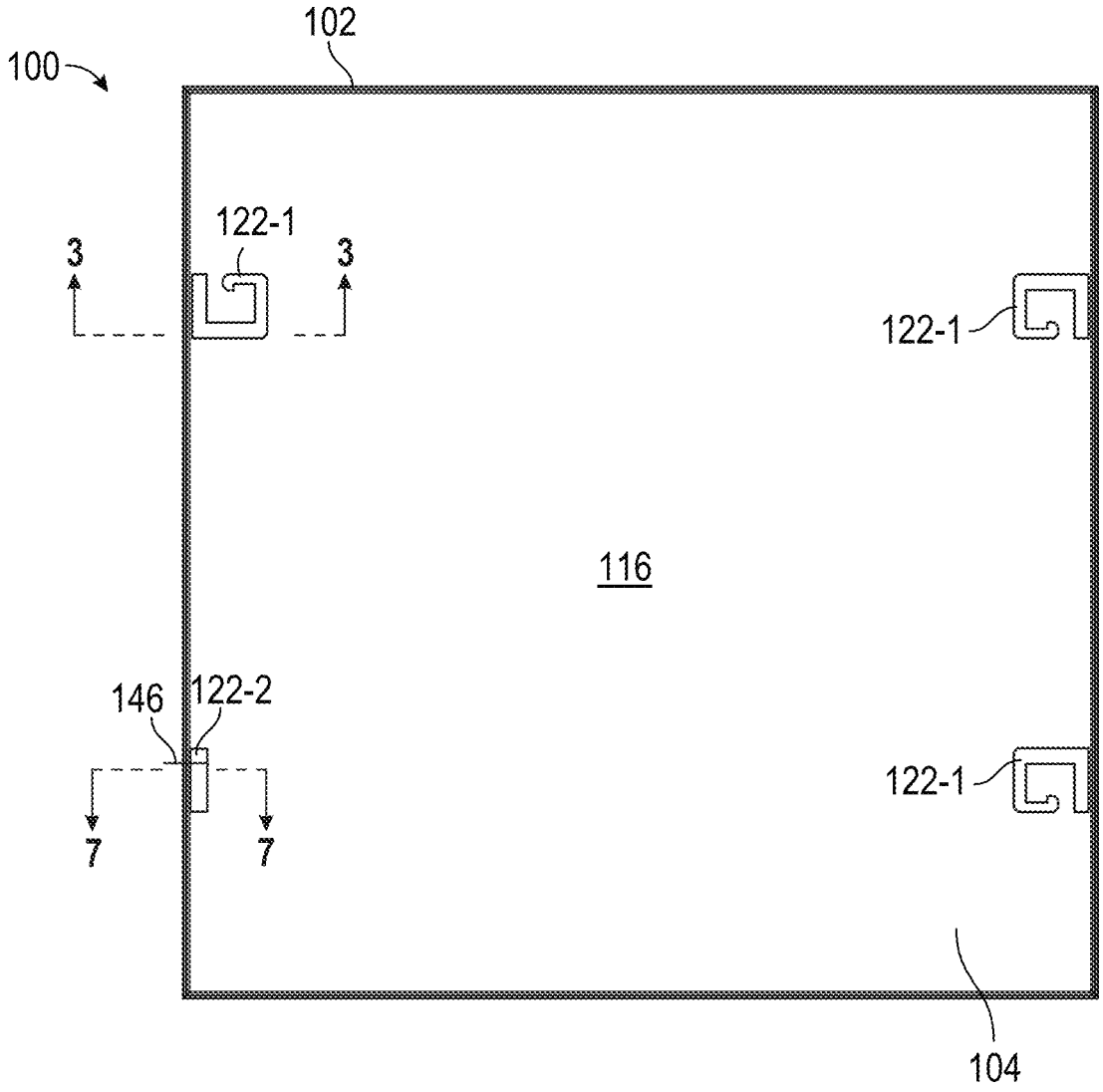
FIG. 1A is a top view of a luminaire assembly according to aspects of the current disclosure.
Figure 1B:
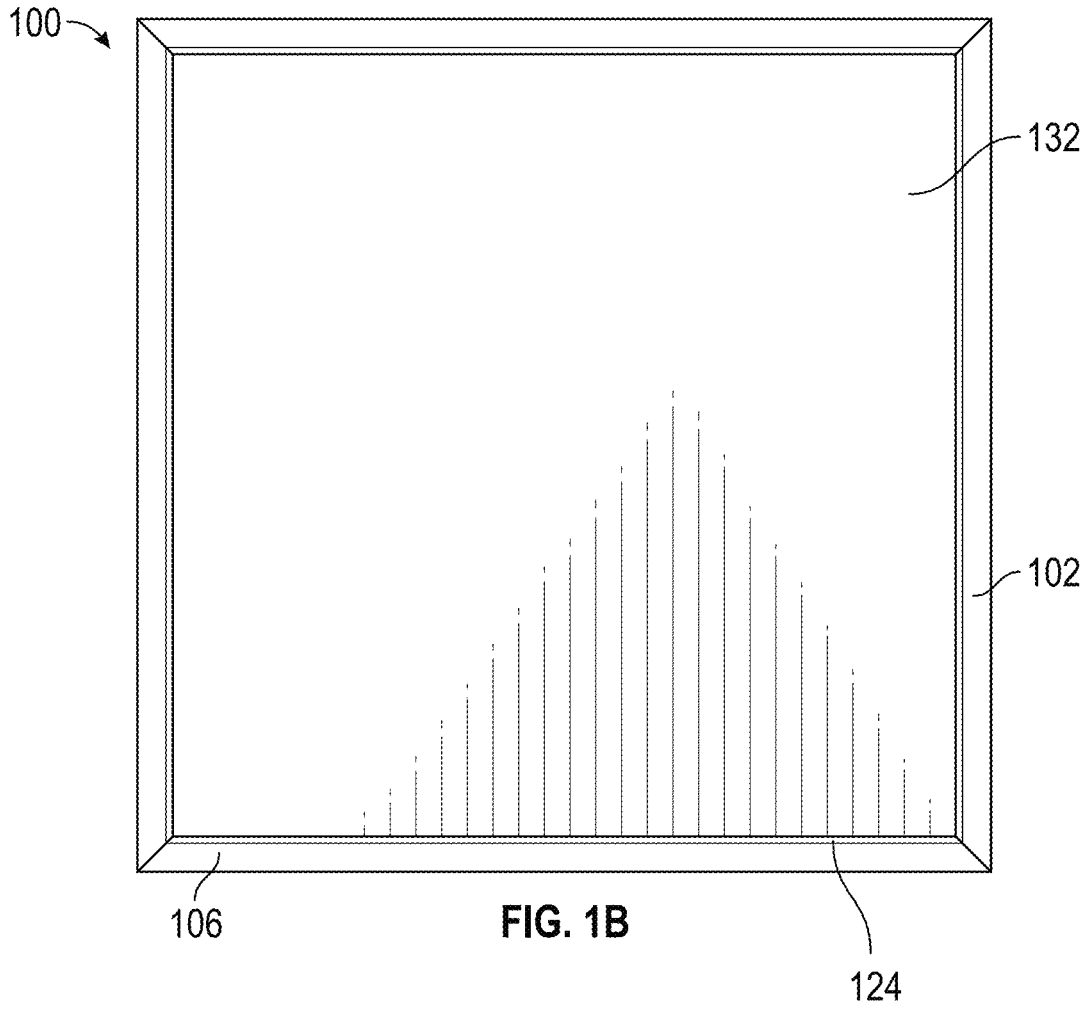
FIG. 1B is a bottom view of the luminaire assembly of FIG. 1A.
Figure 2:
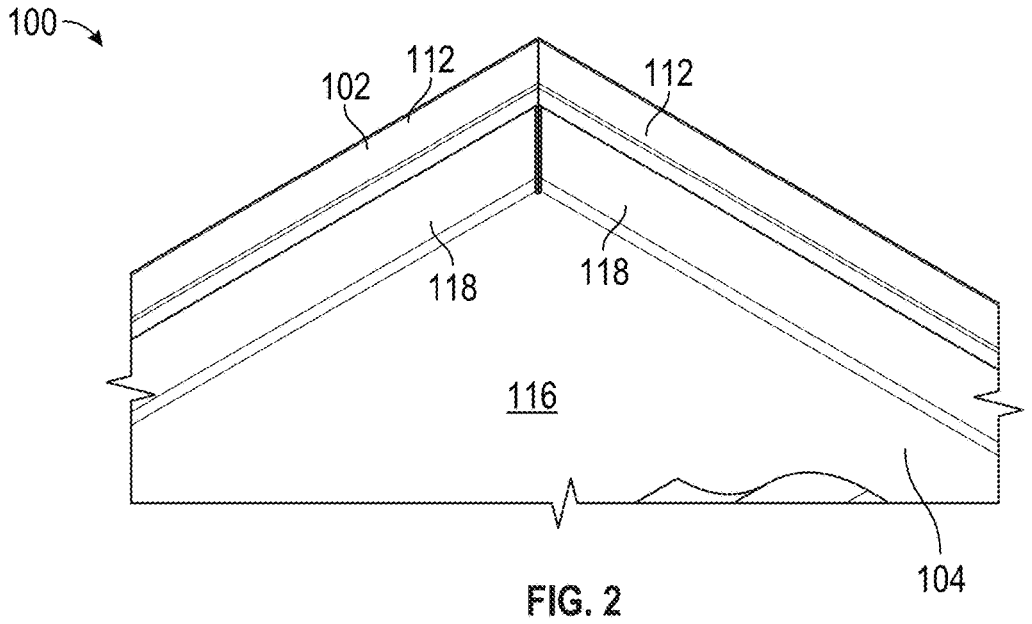
FIG. 2 is a perspective view of a portion of the luminaire assembly of FIG. 1A.

A luminaire 100 generally includes a frame 102 and a back plate 104. As best illustrated in FIGS. 1A-B, the frame 102 defines a perimeter of the luminaire 100. The frame 102 and back plate 104 together define an enclosure that accommodates various components of the luminaire 100 as described below.

Figure 3:
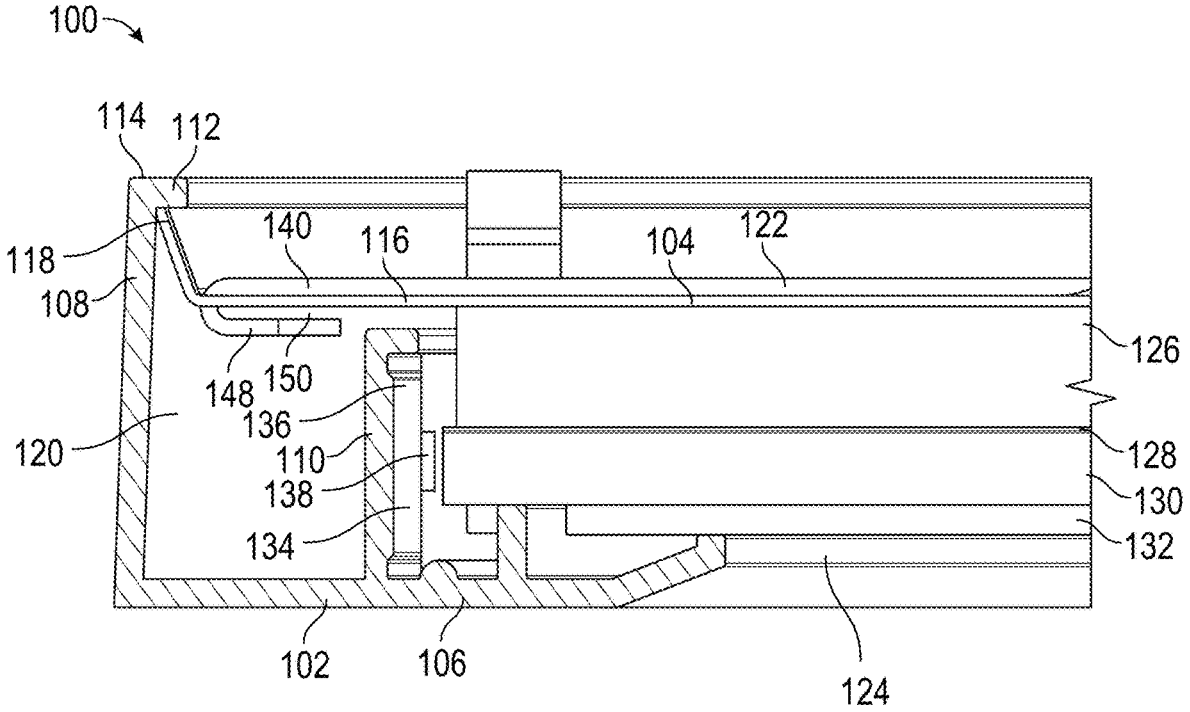
FIG. 3 is a sectional view of the luminaire assembly taken along line 3-3 in FIG. 1A.

The frame 102 includes a base 106 and a sidewall 108, and the base 106 and the sidewall 108 together define a housing area 120. Various components of the luminaire 100 may be positioned within the housing area 120 when the luminaire 100 is assembled. Optionally, the base 106 includes a light source support 110 that supports one or more light sources, such as an LED or other suitable light source as discussed below. In certain embodiments and as illustrated in FIG. 3, the base 106 defines an opening 124 such that light can be emitted from the luminaire 100. In various examples, the frame 102 may be formed from various suitable materials including, but not limited to, sheet metal, polymers, glass, wood, composites, combinations thereof, or various other suitable materials as desired.

The back plate 104 includes a body 116. In some embodiments, the body 116 includes a resilient material that is pliable or bendable. In one example, the body 116 is constructed from a sheet of metal, although in other examples, other suitable materials may be utilized.

In addition to the frame 102 and the back plate 104, the luminaire 100 may include various other components as desired. In some aspects, the components included with the luminaire 100 may depend on the type of luminaire. In the example of FIGS. 1A-8, the luminaire 100 is a layered luminaire that further includes a foam layer 126, a reflector 128, a light guide 130, an optic 132, and a light source 134 (referred to collectively herein as "luminaire layers") within the housing area 120. In various aspects, one or more (and in some embodiments all) of the luminaire layers may be constructed from a wirelessly transparent material (i.e., non-metallic), meaning that a wireless signal can be transmitted through the particular layer.

In some examples, the light source 134 may include at least one printed circuit board (PCB) 136 populated with one or more light emitting diodes (LEDs) 138 that are configured to emit a light source emission. Each PCB can have wiring for connecting to a power supply, which can be shared between PCBs or each PCB could have its own power supply. The LEDs 138 may be single-die or multi-die LEDs, DC or AC, can be organic LEDS, and/or may be various other suitable LEDs. White, color, or multicolor LEDs may be used. Moreover, the LEDs mounted on a PCB need not all be the same color; rather, mixtures of LEDs may be used. Furthermore, in some embodiments no PCB is needed; rather, the LEDs are chip-on-board LEDs. In other examples, the light source 134 may be various other suitable devices for emitting a light source emission. In some cases, the light source 134 is supported by the light source support 110 of frame 102, although it need not be in other examples.

The light guide 130 with associated reflector 128 are configured to direct the light source emission from the light source 134 towards the opening 124. The light guide 130 may include various suitable materials for directing the light source emission including, but not limited to, air, polymers, glass, various transparent materials, and/or various other suitable materials or combinations of materials. In some examples, the light source 134 is arranged adjacent to at least a portion of an edge of the light guide 130 such that the luminaire 100 is an edge-lit luminaire. In some examples, the light source emission from the light source 134 is directly into the light guide 130. In further examples, the luminaire 100 need not be an edge-lit luminaire, and the light source 134 may be provided at other locations relative to the light guide 130.

The optic 132 (such as a lens, diffuser, or other suitable optic) is positioned on or over the opening 124. The optic 132 can be made of any non-metallic material that permits light to exit through the optic 132, including, but not limited to, polymeric materials, silicone and various other suitable materials for light distribution.

Referring to FIG. 3, when the luminaire 100 is assembled, the luminaire layers may be provided within the housing area 120 between the base 106 of the frame 102 and the back plate 104. As mentioned, in other examples, the luminaire 100 may have various other configurations as desired.

Fastener-Less Enclosure System

Referring to FIGS. 1A-3, in some examples, the frame 102 and the back plate 104 of the luminaire 100 form a fastener-less enclosure. As discussed in detail below, by eliminating the use of fasteners to hold the back plate 104 with the frame 102, the luminaire 100 may provide a uniform light distribution by eliminating or reducing the occurrence of dark and light bands caused by uneven pressure distributions associated with use of fasteners. The luminaire 100 may also maintain the positioning of, and thereby reduce misalignment between, the luminaire layers.

As best illustrated in FIG. 3, in some examples, the sidewall 108 of the frame 102 includes a lip 112 that extends inwardly from the sidewall 108 and over at least a portion of the base 106. In some examples, the lip 112 is at an end 114 of the sidewall 108 that is opposite from the base 106. However, in other examples, the lip 112 is provided at a portion of the sidewall 108 that is between the base 106 and the end 114. The lip 112 can extend from the sidewall 108 at various angles, including acute angles, obtuse angles, and orthogonal angles. In various embodiments, the lip 112 is provided along the entire length of the frame 102 (e.g., the sidewall 108 includes the lip 112 for the entire perimeter of the frame 102). In other examples, the lip 112 may be provided along only a portion of the perimeter of the sidewall 108. In the example illustrated in FIGS. 1A-3, the lip 112 is provided along the entire length or perimeter of the frame 102.

In addition to the body 116, in various examples the back plate 104 includes a tab 118 that extends upwardly from the body 116. In some cases, the tab 118 is provided along the entire perimeter of the body 116. In other examples, multiple tabs 118 may extend along only along a portion of the perimeter. In the example illustrated in FIGS. 1A-8, the tab 118 is provided along the entire perimeter of the body 116. The tab 118 can extend from the body 116 at various angles, including acute angles, obtuse angles, and orthogonal angles. In certain examples, such as the example illustrated in FIG. 3, the tab 118 extends at an obtuse angle relative to the body 116. In some embodiments, the tab 118 is formed integrally with the body 116 but it does not have to be. The tab 118 and/or the body 116 may include the pliable or flexible material. The material forming the tab 118 may be the same as or different from the material forming the body 116.

Referring to FIG. 3 and as previously mentioned, the luminaire 100 is assembled such that the luminaire layers are within the housing area 120 between the back plate 104 and the frame 102. To assemble the back plate 104 onto the frame 102, the back plate 104 is positioned on the frame 102 and pushed downwardly such that the tab 118 of the back plate 104 engages the underside of the lip 112 of the frame 102. This snap-fit engagement of the tab 118 with the lip 112 retains the back plate 104 within the housing area 120 and as such may retain the other layers of the luminaire 100 within the housing area 120 without fasteners such as screws, bolts, etc. Engagement of the tab 118 with the lip 112 may also cause the back plate 104 to apply pressure onto the other layers of the luminaire 100 to maintain positioning of the layers and to reduce misalignment of the layers. In various aspects, the foam layer 126 provides an interface between the back plate 104 and at least some of the other layers of the luminaire 100 such that the pressure from the back plate 104 is applied to the other layers of the luminaire 100 through the foam layer 126. While the layer 126 as described as a "foam" layer, it does not necessarily need to be constructed from foam or foam materials. In other examples, the layer 126 maybe formed from various other materials that have at least some compressibility. In various aspects, the layer 126 may be constructed from a material that does not permanently set and loose its compressibility, although this is not a requirement. As some non-limiting examples, the layer 126 may be constructed from materials other than foam such as EPDM rubber, neoprene, or various other suitable materials as desired. In certain cases, the engagement of the tab 118 with the lip 112 creates a uniform perimeter of pressure on the layers of the luminaire 100 such that the layers are held firmly and with equal pressure. Such pressure may be uniformly distributed onto the luminaire layers, and particularly on the optic 132. The uniform pressure distribution may reduce or prevent dark and light bands from forming when the luminaire is used because the pressure is applied uniformly on the optic 132 compared to luminaires that are assembled with fasteners.

In some examples, the engagement of the tab 118 with the lip 112 may compress the tab 118 to further aid in retention of the back plate 104 within the housing area 120 and/or the application of pressure by the back plate 104 on the other layers of the luminaire 100. In other examples, the tab 118 and/or lip 112 may be provided with different configurations on the frame 102 and/or back plate 104 such that the back plate 104 applies a desired pressure profile on the layers of the luminaire 100.

Fastener-Less Luminaire Support Clip

In some examples, the luminaire 100 is configured to accommodate one or more fastener-less luminaire support clips 122.

Figure 4:
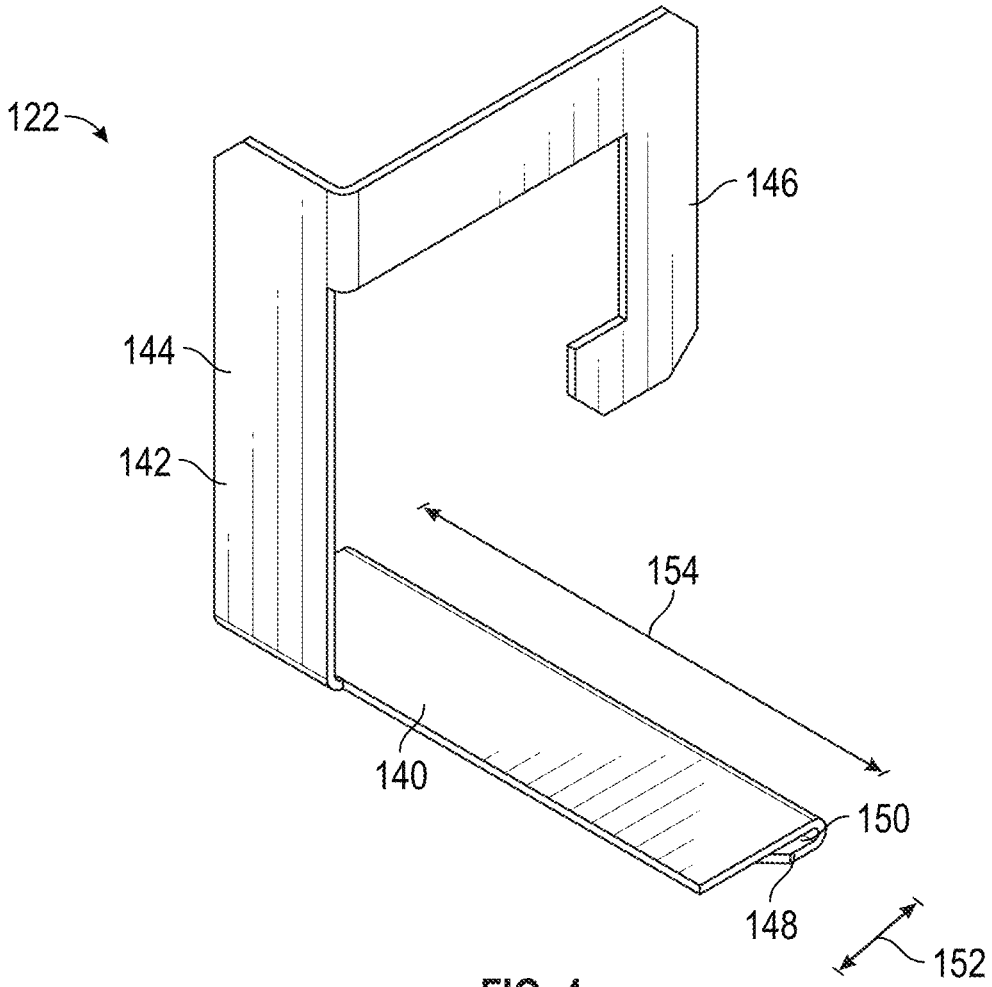
FIG. 4 is a perspective view of a luminaire support clip of the luminaire assembly of FIG. 1A according to aspects of the current disclosure.
Figure 5:
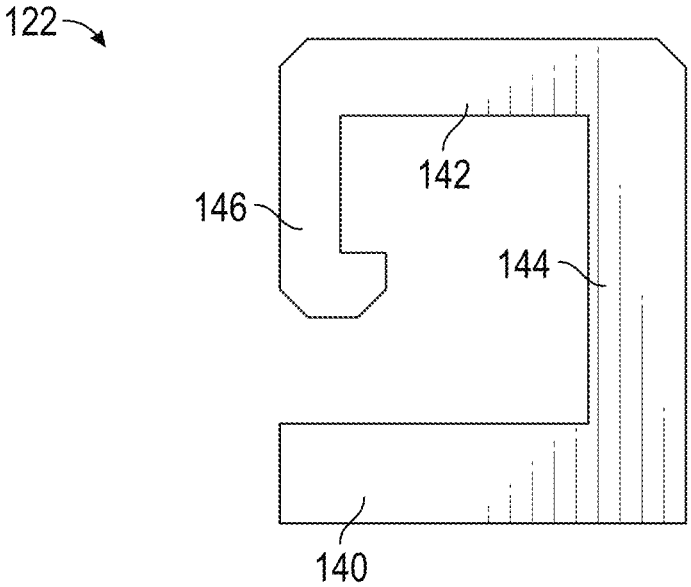
FIG. 5 illustrates the luminaire support clip of FIG. 4 in an un-bent configuration.

As best illustrated in FIGS. 4 and 5, in various examples, the luminaire support clip 122 includes a base 140 and a hook 142 that extends from the base 140. The hook 142 includes a support portion 144 and an engagement portion 146. In some examples, the support portion 144 is bendable relative to the base 140 and/or the engagement portion 146 is bendable relative to the support portion 144 such that the clip 122 is movable between a flat configuration (illustrated in FIG. 5) and an assembled configuration (illustrated in FIG. 4). In some cases, the luminaire support clip 122 may initially be in the flat configuration (see luminaire support clips 122-1 in FIG. 1A) until the luminaire 100 is to be supported by the luminaire support clip 122, in which case the luminaire support clips can be bent into the deployed configuration (see luminaire support clip 122-2 in FIG. 1A).

In addition to the hook 142, the luminaire support clip 122 also includes a tab 148 that extends from the base 140. In some examples, the tab 148 extends from an edge of the base 140 that is opposite from the hook 142, although it need not in other examples. As best illustrated in FIG. 4, the tab 148 is folded relative to the base 140 such that the tab 148 and base 140 together define a receiving area 150. In some examples, the tab 148 is folded over the base 140 (e.g., the tab 148 and the hook 142 are located on the same side of the base 140), while in other examples, the tab 148 is folded under the base 140 (e.g., the tab 148 and hook 142 are located on opposing sides of the base 140).

Referring to FIG. 4, the base 140 defines a base depth 152 and a base length 154. In some examples, a length of the tab 148 is the same as the base length 154, although in other examples, the length of the tab 148 may be less than the base length 154. Similarly, the depth of the tab 148 can be the same or less than the base depth 152. In some examples, the depth of the tab 148 may be at least ⅓ the base depth 152. In various cases, the depth of the tab 148 is at least ½ the base depth 152. It will be appreciated that in other examples, the depth of the tab 148 may be greater than ½ the base depth 152 and/or ⅓ the base depth 152.

Figure 6:
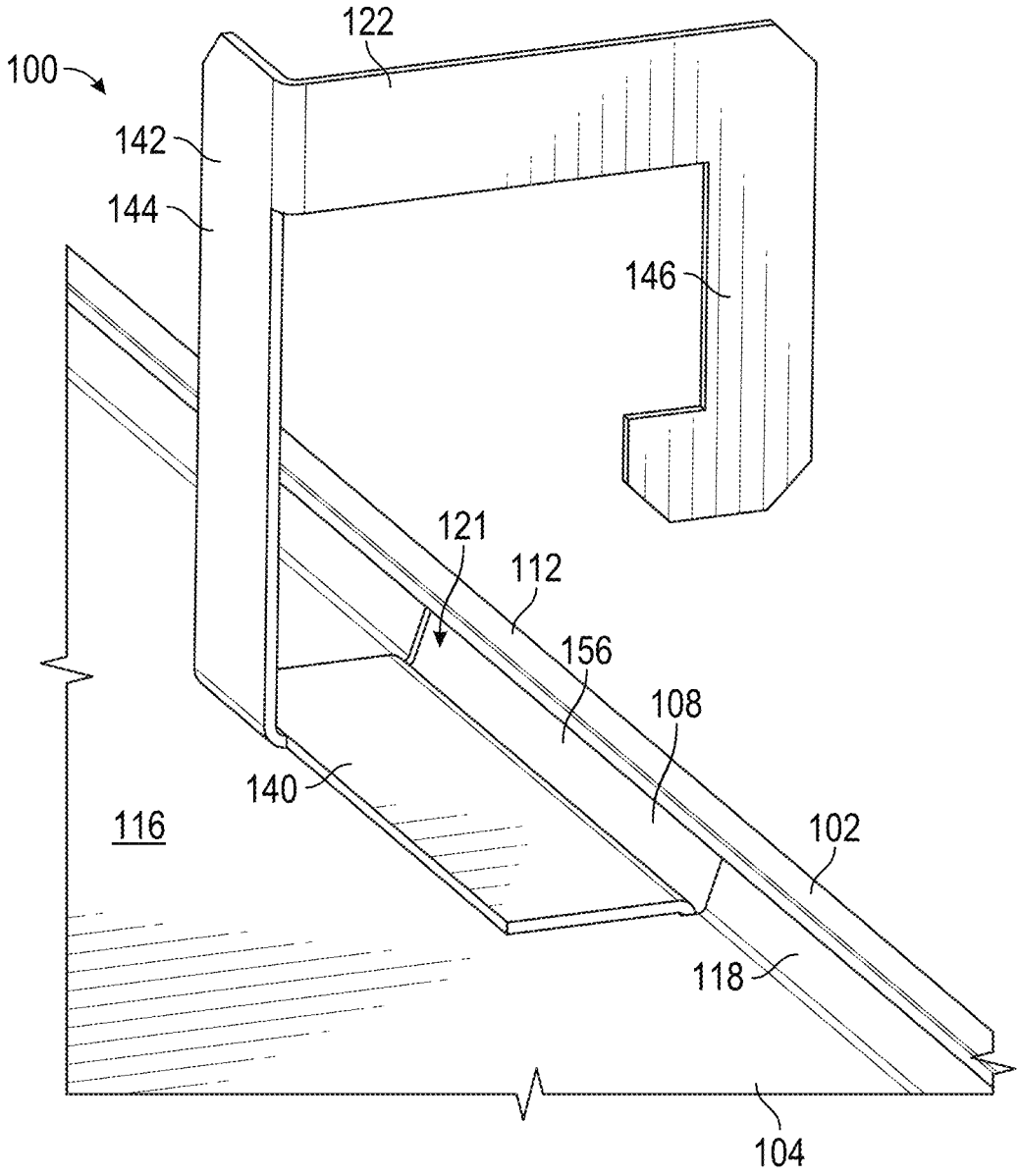
FIG. 6 is a partial perspective view of the luminaire support clip of FIG. 4 installed on the luminaire assembly of FIG. 1A.

As best illustrated in FIG. 6, in various examples, the tab 118 of the back plate 104 does not extend along the entire perimeter of the back plate 104. Rather, portions of the tab 118 are discontinuous so as to define one or more notches 121 in the tab 118. The number, shape, and location of the notch 121 should not be considered limiting on the current disclosure. Each notch 121 is designed to accommodate a luminaire support clip 122, as described in more detail below. As best illustrated in FIGS. 7 and 8, when the back plate 104 is assembled with the frame 102, a gap 156 (having a gap depth 158) is formed between the sidewall 108 of the frame 102 and the edge of the back plate 104 at the location of the notch 121.

Figure 7:
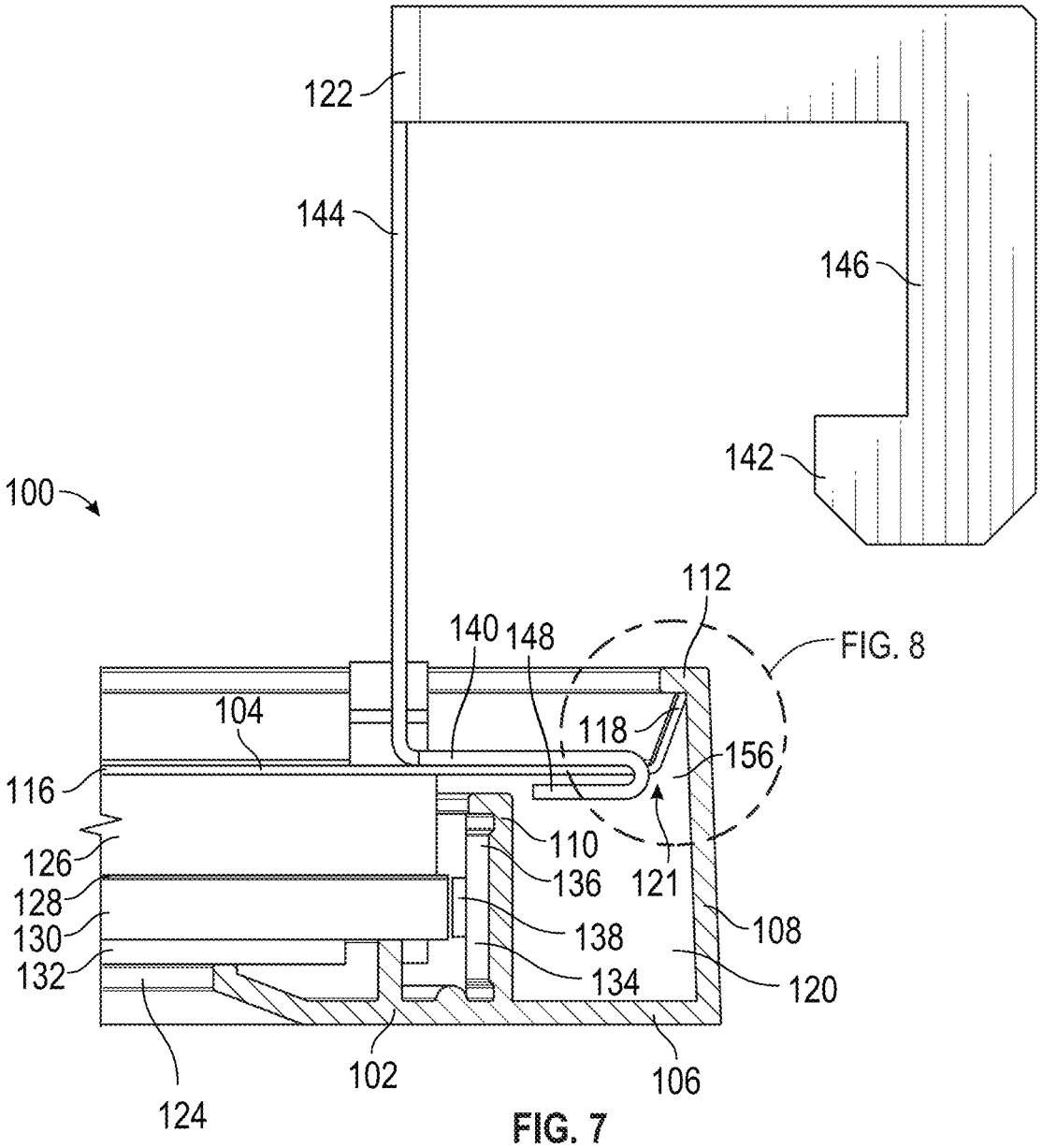
FIG. 7 is a sectional view of the luminaire assembly taken along line 7-7 in FIG. 1A.
Figure 8:
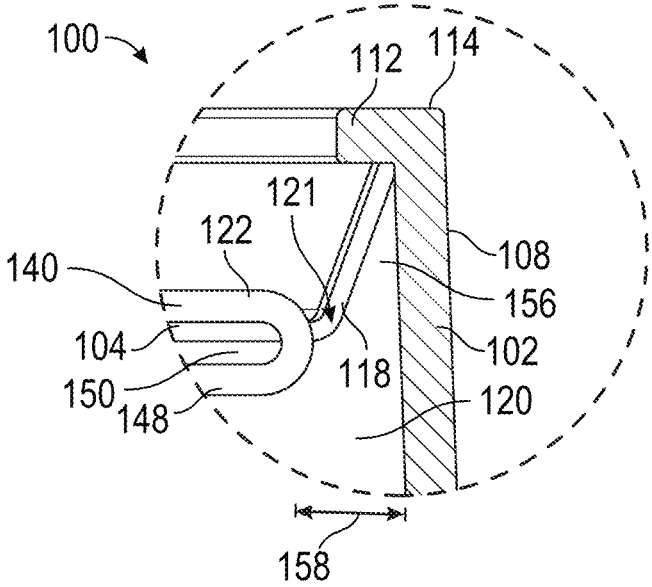
FIG. 8 is a view of the luminaire assembly taken from detail circle 8 in FIG. 7.
Figure 9:
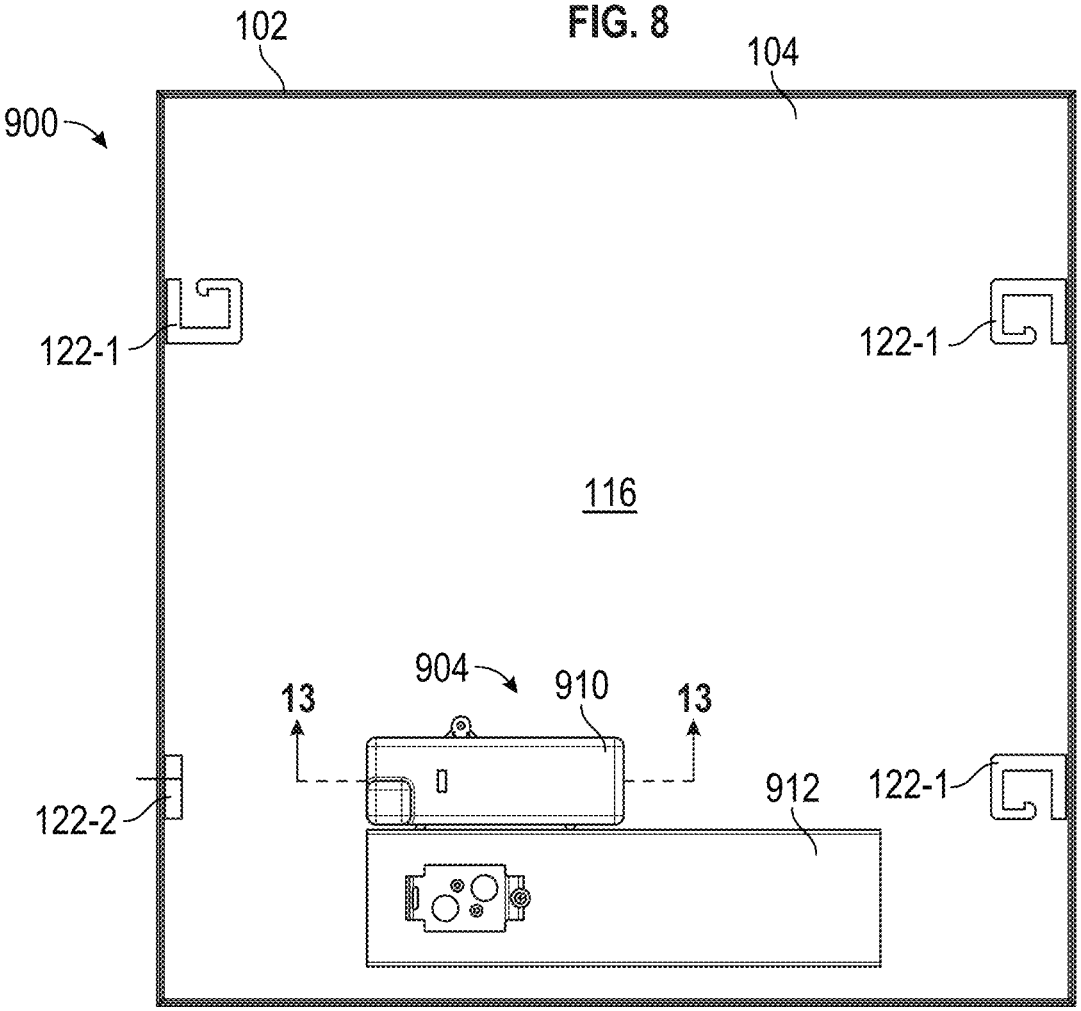
FIG. 9 is a top view of a luminaire assembly that includes a wireless module according to aspects of the current disclosure.

Referring to FIGS. 6-8, in various examples a luminaire support clip 122 is assembled on the luminaire 100 by positioning the luminaire support clip 122 within a notch 121 and sliding or pivoting the luminaire support clip 122 such that a portion of the back plate 104 is received within the receiving area 150 of the luminaire support clip 122 and the tab 148 effectively wraps around the edge of the back plate 104 at the notch 121. In some embodiments, the length of the notch is only slightly larger than the base length 154 to restrict longitudinal movement of the luminaire support clip 122 relative to the back plate 104. In various cases, the depth of the tab 148 is greater than the gap depth 158. Thus, while the luminaire support clip 122 may be movable laterally relative to the back plate 104 to permit its installation on the back plate 104, the sidewall 108 of the frame 102 will prevent the luminaire support clip 122 from backing off the back plate 104.

In this way, the luminaire support clip 122 may be installed and retained on the luminaire 100 without requiring fasteners. Once installed, the hooks may engage various structures or items to support the luminaire such as an acoustical ceiling grid. The luminaire support clip 122 may also be configured for wire-support (or other suitable types of support) to various other architectural members as desired. The luminaire support clip 122 further allows for easy replacement or repair of the luminaire support clips 122 such that the luminaire support clips 122 can accommodate different types of hangers and/or different types of ceilings in the field without significant processing. In some examples, the luminaire support clip 122 can be easily changed to other types of hangers in the field to change the type of luminaire. For example, the luminaire support clip 122 can be changed to convert a luminaire from a recess luminaire to a suspended luminaire. In addition, the luminaire support clip 122 can be changed to accommodate different types of ceilings.

Wireless Module

In some examples, the luminaire may accommodate one or more wireless modules. FIGS. 9-13 illustrate an example of a luminaire 900 that is substantially similar to the luminaire 100 except that the back plate 104 further defines a wireless module opening 902 (see FIG. 10). In various aspects, the luminaire layers within the housing area 120 and beneath the module opening 902 are wirelessly transparent materials such as various polymers, glass, composites, or other suitable materials.

The luminaire 900 also includes a wireless module 904 that may be provided natively or through a retrofit kit. The wireless module 904 may have the capability to communicate wirelessly according to a Bluetooth®, Wi-Fi®, NFC, LiFi, 3G, or other standardized or proprietary wireless protocol. The wireless module 904 may be connected to a driver housing in a driver box 912 and/or various other components of the luminaire 900 as desired. In various examples, the wireless module 904 includes a controller 906 and an antenna 908. The wireless module 904 may be housed in a module cover 910 that supports the controller 906 and/or antenna 908. In certain aspects, the module cover 910 is constructed from a wirelessly transparent material (e.g., a non-metallic material such as a polymeric material) such that a wireless signal from the antenna 908 may be transmitted through the module cover 910.

Figure 10:
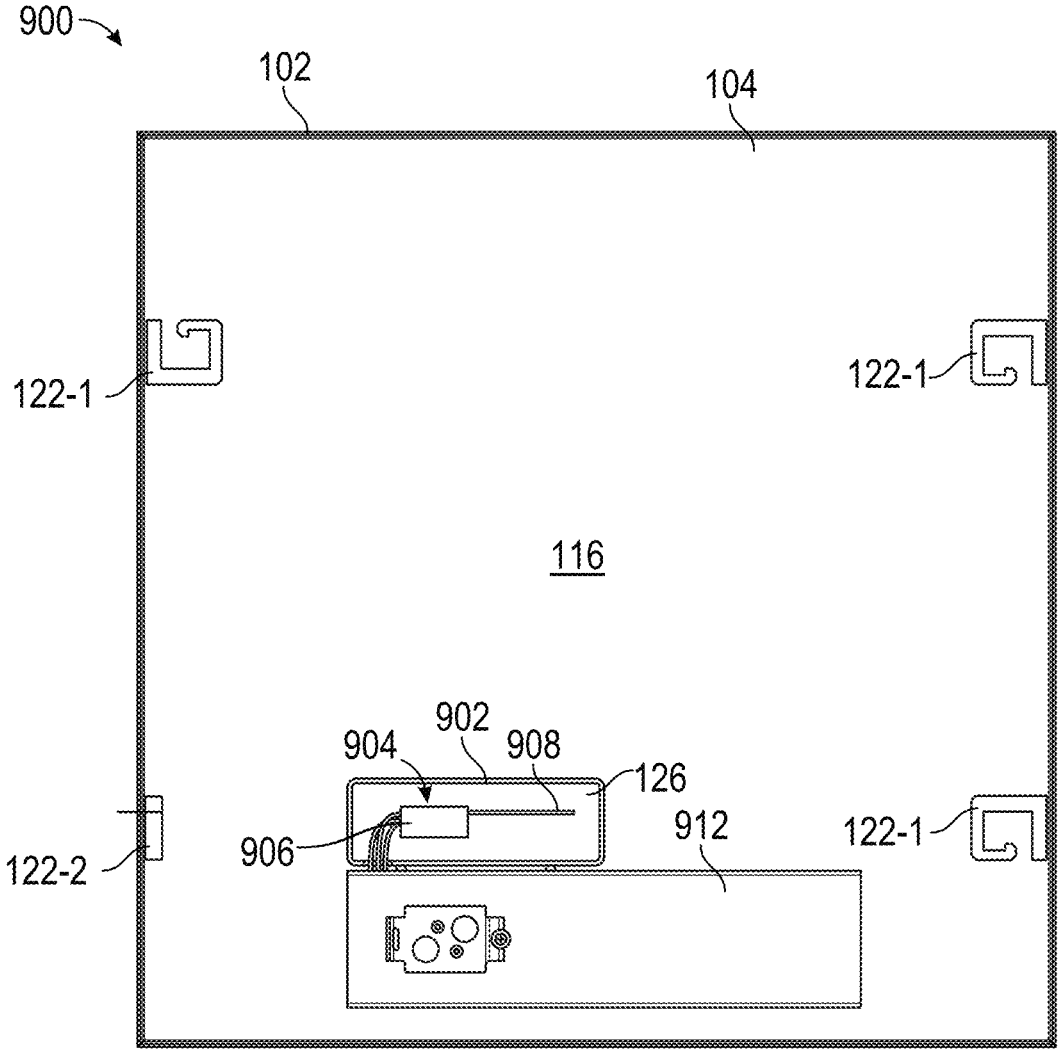
FIG. 10 is another top view of the luminaire assembly of FIG. 9 with a module cover removed.
Figure 11:
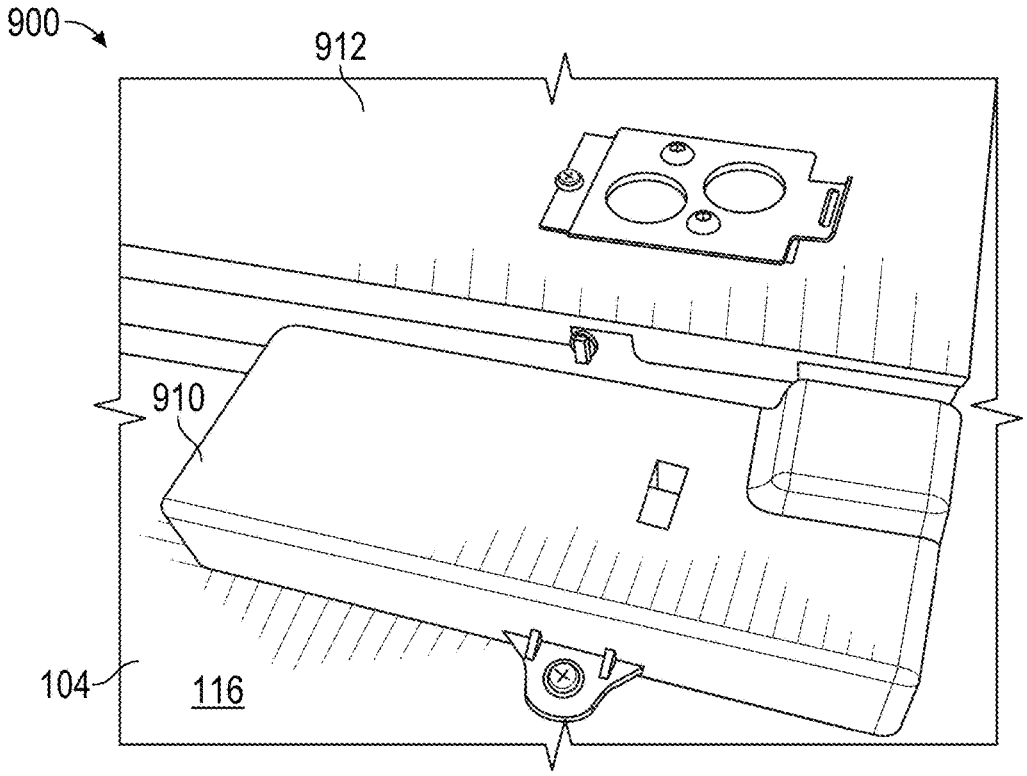
FIG. 11 is a partial perspective view of a portion of the luminaire assembly of FIG. 9.
Figure 12:
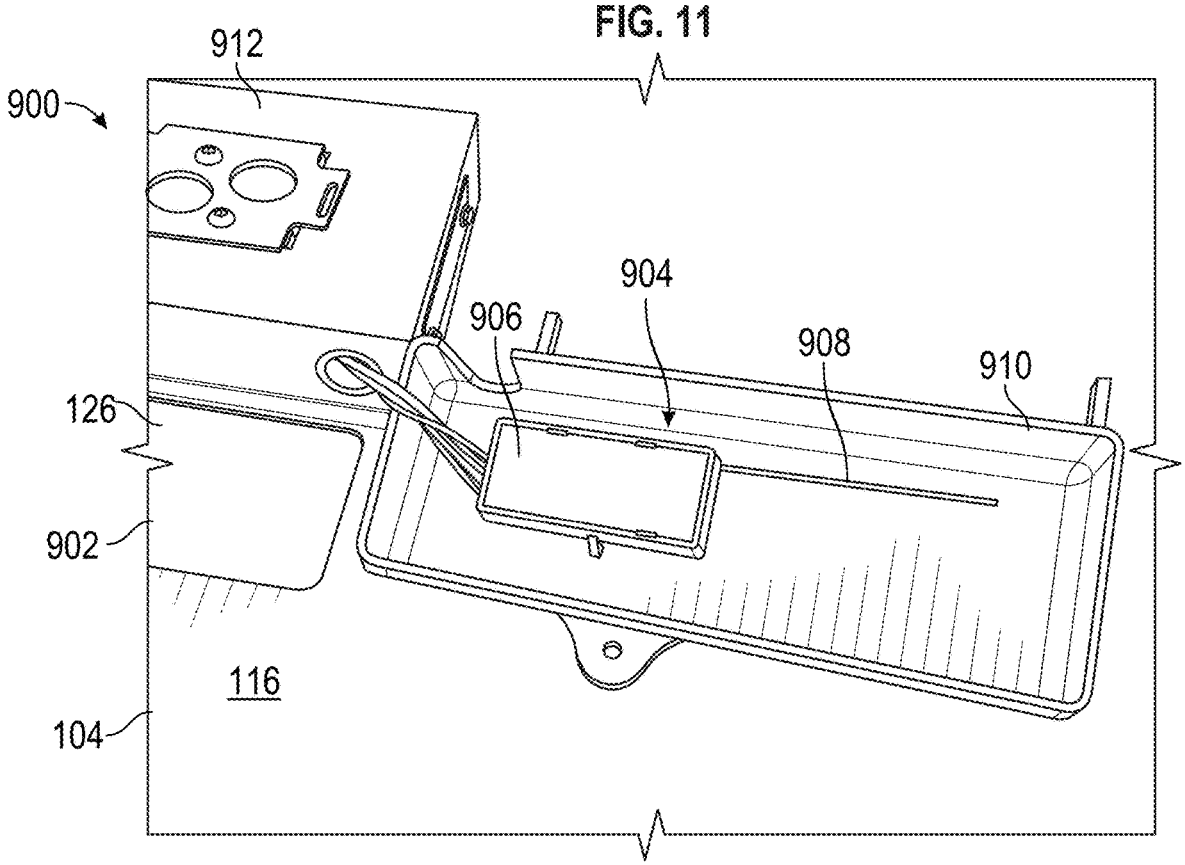
FIG. 12 is another partial perspective view of a portion of the luminaire assembly of FIG. 9.
Figure 13:
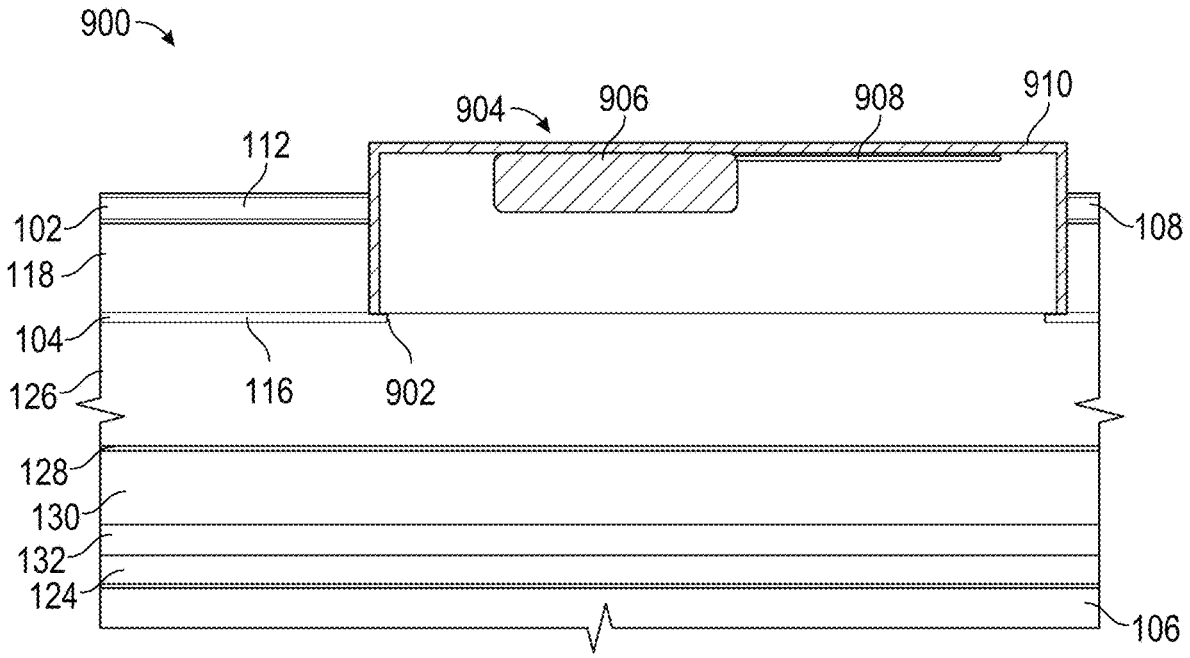
FIG. 13 is a sectional view of the luminaire assembly of FIG. 9 taken along line 13-13 in FIG. 9.

As best illustrated in FIGS. 10 and 13, the wireless module 904 can be arranged such that the antenna 908 is aligned with and adjacent to the module opening 902 provided in the back plate 104. In this way and because the materials of the luminaire 900 below the module opening 902 are all formed of material transparent to the wireless signal, signals may be transmitted through the luminaire 900 to the area below the luminaire 900. Similarly and because the wireless module 904 is housed in a module cover 910 formed from a wirelessly transparent material, signals may be transmitted through the module cover 910 to the area above the luminaire 900. In this way, signals may be transmitted above, below, and thru the plenum.

In various examples, the antenna 908 is arranged such that it is substantially parallel to a plane of the back plate 104, such as a plane of the body 116 of the back plate 104. In some cases, the antenna 908 is supported such that the antenna is coplanar with the plane of the back plate 104; however, in other examples, the antenna 908 may be supported above or below the plane of the back plate 104. In certain cases, the antenna 908 is supported close to the plane of the back plate 104 such that the area of interference from the back plate 104 is minimized (i.e., most of the wireless signal from the antenna 908 can be transmitted with minimal interference from the back plate 104). In various examples, the antenna 908 is supported on a non-light emitting side of the luminaire 900.

Through the wireless module 904, a wireless signal can be transmitted both above and below the luminaire 900, and the interference from the back plate 104 minimized.

It will be appreciated that luminaires according to embodiments of the present invention can, but need not, embody each of the fastener-less enclosure system, the fastener-less luminaire support clips, and the wireless module. Rather, embodiments may embody any single feature or combination of such features.

A collection of exemplary examples, including at least some explicitly enumerated as "ECs" (Example Combinations), providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

EC 1. A luminaire assembly comprising: a frame comprising a base and a sidewall, wherein the frame defines a housing area for the luminaire assembly, and wherein the sidewall comprises a lip that extends from the sidewall over at least a portion of the base; and a back plate positionable within the housing area of the frame, wherein the back plate comprises a body and a tab extending from the body, wherein the tab is selectively engageable with the lip such that the back plate is retained within the frame.

EC 2. The luminaire assembly of any of the preceding or subsequent example combinations, wherein the lip is defined at an end of the sidewall that is opposite from the base.

EC 3. The luminaire assembly of any of the preceding or subsequent example combinations, wherein the frame defines a perimeter of the luminaire assembly, and wherein the lip is defined along the perimeter.

EC 4. The luminaire assembly of any of the preceding or subsequent example combinations, wherein the tab extends from the body of the back plate at a non-square and non-zero angle.

EC 5. The luminaire assembly of any of the preceding or subsequent example combinations, wherein the tab is configured to engage the lip such that the tab is compressed and the back plate is retained within the frame under pressure.

EC 6. The luminaire assembly of any of the preceding or subsequent example combinations, further comprising a luminaire layer comprising at least one of an optic, a foam layer, a light guide, and a reflector within the housing area between the back plate and an opening defined in the base of the frame, and wherein the back plate is retained within the frame such that the back plate transfers the pressure onto the luminaire layer.

EC 7. The luminaire assembly of any of the preceding or subsequent example combinations, wherein the lip extends along a perimeter of the frame and wherein the tab extends along a perimeter of the body, and wherein the tab is selectively engageable with the lip such that the tab is compressed and a perimeter of pressure is applied onto the back plate.

EC 8. The luminaire assembly of any of the preceding or subsequent example combinations, further comprising a light guide, at least one LED, and an optic within the housing area between the back plate and an opening defined in the base of the frame, and wherein the LED is arranged along an edge of the light guide such that the LED provides edge lighting.

EC 9. A method of assembling a luminaire, the method comprising: positioning a back plate within a housing area defined by a frame, wherein the frame comprises a base and a sidewall, wherein the sidewall comprises a lip that extends from the sidewall over at least a portion of the base, and wherein the back plate comprises a body and a tab extending from the body; and retaining the back plate within the frame by engaging the tab of the back plate with the lip of the frame.

EC 10. The method of any of the preceding or subsequent example combinations, wherein engaging the tab with the lip comprises compressing the tab such that the back plate is retained within the frame under pressure.

EC 11. The method of any of the preceding or subsequent example combinations, wherein the lip extends along a perimeter of the frame and wherein the tab extends along a perimeter of the base, and wherein engaging the tab with the lip comprises compressing the tab such that the tab is compressed and a perimeter of pressure is applied onto the back plate.

EC 12. The method of any of the preceding or subsequent example combinations, further comprising positioning a luminaire layer within the housing area, wherein positioning the back plate comprises positioning the back plate such that the luminaire layer is between the back plate and the base of the frame, and wherein retaining the back plate comprises engaging the tab with the lip such that the back plate applies pressure onto the luminaire layer.

EC 13. The method of any of the preceding or subsequent example combinations, wherein the luminaire layer comprises at least one of an optic, a foam layer, a light guide, and a reflector.

EC 14. The method of any of the preceding or subsequent example combinations, wherein retaining the back plate within the frame comprises retaining the back plate without fasteners.

EC 15. A luminaire support clip for a luminaire assembly, the luminaire support clip comprising: a base; a hook extending from the base; and a tab extending from the base and folded under the base such that the tab and the base define a receiving area, wherein the luminaire support clip is configured to receive a portion of an edge of a back plate of the luminaire assembly within the receiving area.

EC 16. The luminaire support clip of any of the preceding or subsequent example combinations, wherein the base comprises a pair of opposing edges, wherein the hook extends from a first edge of the pair of opposing edges, and wherein the tab extends from a second edge of the pair of opposing edges.

EC 17. The luminaire support clip of any of the preceding or subsequent example combinations, wherein the base defines a length and a width, wherein the tab defines a length and a width, and wherein the width of the tab is less than the width of the base.

EC 18. The luminaire support clip of any of the preceding or subsequent example combinations, wherein the length of the tab is equal to the length of the base.

EC 19. The luminaire support clip of any of the preceding or subsequent example combinations, wherein the width of the tab is at least ⅓ the width of the base.

EC 20. The luminaire support clip of any of the preceding or subsequent example combinations, wherein the width of the tab is about ½ the width of the base.

EC 21. The luminaire support clip of any of the preceding or subsequent example combinations, wherein the hook is bendable relative to the base.

EC 22. The luminaire support clip of any of the preceding or subsequent example combinations, wherein the hook comprises a support portion and an engagement portion, and wherein the engagement portion is bendable relative to the support portion between a coplanar configuration and a non-coplanar configuration.

EC 23. A luminaire assembly comprising: a back plate comprising a body having a perimeter edge; and a luminaire support clip comprising a base, a hook, and a tab, wherein the tab and base define a receiving area, and wherein a portion of the perimeter edge of the back plate is retained within the receiving area such that the luminaire support clip is removably engaged with the back plate.

EC 24. The luminaire assembly of any of the preceding or subsequent example combinations, wherein the perimeter edge of the back plate defines a notch, and wherein the luminaire support clip retains the perimeter edge of the back plate within the notch.

EC 25. The luminaire assembly of any of the preceding or subsequent example combinations, wherein the tab comprises a tab width, wherein the notch comprises a notch width, and wherein the tab width is greater than the notch width.

EC 26. The luminaire assembly of any of the preceding or subsequent example combinations, wherein the base of the hook comprises a base width, wherein the tab comprises a tab width, and wherein the tab width is less than the base width.

EC 27. The luminaire assembly of any of the preceding or subsequent example combinations, wherein the tab width is about ½ the base width.

EC 28. The luminaire assembly of any of the preceding or subsequent example combinations, further comprising: a frame comprising a base and a sidewall, wherein the frame defines a housing area for the luminaire assembly, and wherein the sidewall comprises a lip that extends from the sidewall over at least a portion of the base, wherein the back plate is positionable within the housing area of the frame such that the perimeter edge engages the lip of the frame, wherein a portion of the perimeter edge of the back plate defines a notch and the notch defines a gap between the perimeter edge of the back plate and the frame, and wherein the luminaire support clip retains the perimeter edge of the back plate within the notch.

EC 29. The luminaire assembly of any of the preceding or subsequent example combinations, wherein a width of the gap defined by the notch is less than a width of the tab.

EC 30. The luminaire assembly of any of the preceding or subsequent example combinations, wherein the luminaire support clip is movable within the notch while remaining engaged with the back plate.

EC 31. A method of assembling a luminaire, the method comprising: assembling a luminaire support clip such that a hook of the luminaire support clip extends from a base of the luminaire support clip; and positioning the luminaire support clip on a back plate by inserting a portion of a perimeter edge of the back plate within a receiving area defined by the base of the luminaire support clip and a tab of the luminaire support clip.

EC 32. The method of any of the preceding or subsequent example combinations, wherein the perimeter edge of the back plate defines a notch, and wherein positioning the luminaire support clip comprises positioning the luminaire support clip within the notch.

EC 33. The method of any of the preceding or subsequent example combinations, further comprising assembling a frame with the back plate such that the perimeter edge engages a lip of the back plate and the luminaire support clip is retained within the notch between the portion of the perimeter edge defining the notch and the frame.

EC 34. The method of any of the preceding or subsequent example combinations, further comprising moving the luminaire support clip within the notch while remaining engaged with the back plate.

EC 35. The method of any of the preceding or subsequent example combinations, wherein assembly the luminaire support clip comprises bending the hook relative to the base.

EC 36. A luminaire assembly comprising: a back plate comprising a top side and a bottom side, wherein the back plate defines a module opening extending from the top side to the bottom side; and a wireless module comprising an antenna positioned adjacent to the module opening that is configured to provide wireless transmissions above the top side of the back plate and below the bottom side of the back plate.

EC 37. The luminaire assembly of any of the preceding or subsequent example combinations, wherein the back plate defines a plate plane, and wherein the antenna is arranged parallel to the plate plane.

EC 38. The luminaire assembly of any of the preceding or subsequent example combinations, wherein the antenna is arranged such that it is coplanar with the plate plane.

EC 39. The luminaire assembly of any of the preceding or subsequent example combinations, wherein the antenna is arranged such that it is non-coplanar with the plate plane.

EC 40. The luminaire assembly of any of the preceding or subsequent example combinations, wherein the wireless module comprises a module housing, wherein the module housing comprises a wirelessly transparent material, and wherein the antenna is supported within the module housing.

EC 41. The luminaire assembly of any of the preceding or subsequent example combinations, wherein the top side is a non-light emitting side, and wherein the bottom side is a light emitting side, and wherein the wireless module is provided on the non-light emitting side.

EC 42. The luminaire assembly of any of the preceding or subsequent example combinations, further comprising at least one wirelessly transparent component arranged beneath the bottom side of the back plate and over the module opening.

EC 43. The luminaire assembly of any of the preceding or subsequent example combinations, wherein the at least one wirelessly transparent component comprises at least one of an optic, a foam layer, a light guide, and a reflector.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A luminaire assembly comprising:

a frame;

a back plate comprising a top side and a bottom side, wherein the back plate defines a module opening extending from the top side to the bottom side, wherein the top side of the back plate is an outermost surface of the luminaire assembly, and wherein the frame and the back plate together define an enclosure configured to house a light source; and a module comprising:

a module cover on the top side of the back plate; and a wireless module comprising:

a controller; and an antenna, wherein the module cover houses and supports the controller and the antenna of the wireless module above the top side of the back plate and positioned adjacent to the module opening, and wherein the antenna is configured to provide wireless transmissions above the top side of the back plate and below the bottom side of the back plate.

2. The luminaire assembly of claim 1, wherein the back plate defines a plate plane, and wherein the antenna is arranged parallel to the plate plane.

3. The luminaire assembly of claim 2, wherein the antenna is arranged such that it is non-coplanar with the plate plane.

4. The luminaire assembly of claim 1, wherein the module cover comprises a wirelessly transparent material.

5. The luminaire assembly of claim 1, further comprising at least one wirelessly transparent component arranged beneath the bottom side of the back plate and covering the module opening, and wherein the at least one wirelessly transparent component comprises at least one of an optic, a foam layer, a light guide, and a reflector.

6. A luminaire assembly comprising:

a frame comprising a base and a sidewall, wherein the frame defines a housing area for the luminaire assembly, and wherein the sidewall comprises a lip that extends from the sidewall over at least a portion of the base; and a back plate positionable within the housing area of the frame, wherein the back plate comprises a body and a tab extending from the body, wherein the tab is selectively engageable with the lip such that the back plate is retained within the frame, wherein the tab is configured to engage the lip such that the tab is compressed and the back plate is retained within the frame under pressure.

7. The luminaire assembly of claim 6, wherein the lip is defined at an end of the sidewall that is opposite from the base.

8. The luminaire assembly of claim 6, wherein the frame defines a perimeter of the luminaire assembly, and wherein the lip is defined along the perimeter.

9. The luminaire assembly of claim 6, wherein the tab extends from the body of the back plate at an obtuse angle.

10. The luminaire assembly of claim 6, further comprising a luminaire layer comprising at least one of an optic, a foam layer, a light guide, and a reflector within the housing area between the back plate and an opening defined in the base of the frame, and wherein the back plate is retained within the frame such that the back plate transfers the pressure onto the luminaire layer.

11. The luminaire assembly of claim 6, wherein the lip extends along a perimeter of the frame and wherein the tab extends along a perimeter of the body, and wherein the tab is selectively engageable with the lip such that the tab is compressed and a perimeter of pressure is applied onto the back plate.

12. The luminaire assembly of claim 6, further comprising a light guide, at least one light emitting diode (LED), and an optic within the housing area between the back plate and an opening defined in the base of the frame, and wherein the LED is arranged along an edge of the light guide such that the LED provides edge lighting.

13. The luminaire assembly of claim 6, wherein a perimeter edge of the back plate defines a notch, and wherein the luminaire assembly further comprises a luminaire support clip retained within the notch between the back plate and the frame.

14. A luminaire support clip for a luminaire assembly, the luminaire support clip comprising:

a base;

a hook extending from the base; and a tab extending from the base and folded relative to the base such that the tab and the base define a receiving area, wherein the luminaire support clip is configured to receive a portion of an edge of a back plate of the luminaire assembly within the receiving area, wherein the base comprises a pair of opposing edges, wherein the hook extends from a first edge of the pair of opposing edges, and wherein the tab extends from a second edge of the pair of opposing edges.

15. The luminaire support clip of claim 14, wherein the base comprises a base width, wherein the tab comprises a tab width, and wherein the tab width is less than the base width.

16. The luminaire support clip of claim 15, wherein the tab width is at least ½ the width of the base.

17. The luminaire support clip of claim 14, wherein the hook is bendable relative to the base, wherein the hook comprises a support portion and an engagement portion, and wherein the engagement portion is bendable relative to the support portion between a coplanar configuration and a non-coplanar configuration.

* * * * *